United States Patent [19]

Johnson

[11] 4,443,990

[45] Apr. 24, 1984

[54] METHOD OF PRODUCING CRACK FREE LOGS

[76] Inventor: Wilfred B. Johnson, Star Rte. Box 3289, Manistique, Mich. 49854

[21] Appl. No.: 357,202

[22] Filed: Mar. 11, 1982

[51] Int. Cl.[3] ..... B27K 5/00

[52] U.S. Cl. ..... 52/514; 52/233; 52/730; 144/346; 144/368

[58] Field of Search ..... 144/344, 345, 346, 350, 144/365, 368, 369, 330; 52/723, 726, 514, 233, 730

[56] References Cited

U.S. PATENT DOCUMENTS

| | | | |
|---|---|---|---|
| 2,018,712 | 10/1935 | Elmendorf | 144/346 |
| 2,570,588 | 10/1951 | Nylund | 144/330 |
| 3,357,463 | 12/1967 | Franscioni | 144/330 |
| 3,863,409 | 2/1975 | Fell | 52/233 |
| 3,992,838 | 11/1976 | Vizziello | 52/309.4 |
| 4,047,350 | 9/1977 | Chisum | 52/726 |
| 4,230,163 | 10/1980 | Barton | 144/137 |

FOREIGN PATENT DOCUMENTS

| | | | |
|---|---|---|---|
| 68058 | 7/1944 | Norway | 52/233 |

*Primary Examiner*—W. D. Bray
*Assistant Examiner*—Jorji M. Griffin
*Attorney, Agent, or Firm*—Harvey B. Jacobson

[57] ABSTRACT

A method of processing and producing crack free logs by making a saw cut along opposite longitudinal side portions of a log immediately after harvesting and thus curing the log, without debarking, in a shaded, ventilated air space so that any cracks will be concentrated along the saw cuts. When a finished appearance is desired, a groove is formed along the opposite side portions of the log in registry with the saw cuts and a spline or strip of wood is inserted in each groove so that it projects beyond the periphery of the leg with the spline or strip being secured in the grooves by glueing or the like. The peripheral or exterior portion of the spline or strips is peeled or cut off so that the resulting surface is contiguous with the peripheral surface of the log.

9 Claims, 6 Drawing Figures

METHOD OF PRODUCING CRACK FREE LOGS

BACKGROUND OF THE INVENTION

The present invention relates to a method of producing crack free logs including steps for releasing water and moisture from the logs during curing by forming a pair of saw cuts in opposite longitudinal surfaces thereof without debarking the log to minimize cracking and warping when curing with any cracks which occur being concentrated at the bottom of the saw cuts. A groove is formed in opposite longitudinal surfaces of the cured logs in registry with the saw cuts. A groove filler strip or spline is glued or otherwise secured in the respective grooves within the log and then the exterior or peripheral and extending portions thereof are pealed off and the surrounding log surface has a contiguous smooth finish.

FIELD OF THE INVENTION

Logs have long been processed into a natural, semi-finished or finished condition and used as building material for construction of log homes, log cabin recreational facilities, cabins or industrial facilities. Also, logs are often used in connection with furniture items and as utility poles. In many cases, logs are harvested while they are green or often too soon after the fall season; for this reason the harvested logs contain excessive moisture which causes them to twist, warp, and have excessive cracks throughout the log. Even when logs are harvested a month or more after the leaves fall, some moisture retention exists in the logs without the logs being cured for allowing escape and release of water and moisture bound within the logs.

It is within the purview of the present invention to provide a curing process and method of releasing the bound moisture and permitting water prevailing within the log to escape by forming saw cuts and to subsequently process the log to form a groove over each saw cut and a filler strip or spline fixed in each groove resulting in a log that essentially resembles a natural log.

DESCRIPTION OF THE PRIOR ART

Many and various processes of harvesting, finishing and improving logs are known and generally representative of apparatus and methods and processes of the prior art are shown by disclosures in the following U.S. Pat. Nos.:

1,813,455—H. B. Lawton
2,130,231—E. A. Forciea
2,416,162—W. C. Drake
3,527,005—B. M. Slavens
3,992,838—V. M. Vizziello
4,067,368—W. K. Beecroft.

Some of the known logs have opposed surfaces for receiving connecting keys or splines or wood strips. Others have various types of notching arrangements for interconnecting logs oriented in a particular relation. None of these patents discloses a process for producing a crack free natural log nor of providing a combination of elements that results in a natural log having a groove which has been filled with a wood strip that is glued therein and then finished for resembling the contour of the log. These patents, whether considered singly or in combination with each other, are believed to have no bearing on the patentability of any claim of this invention.

SUMMARY OF THE INVENTION

An object, advantage and feature of the present invention is that a process is directed to the manufacture of a crack free natural log in which essentially all moisture, water and the like bound within the natural log is released and allowed to escape so that there results a log that is prevented from rotting or otherwise deteriorating due to the factors otherwise bound within the log.

Another object and advantage of the invention is to provide logs, whether utility poles, furniture items or construction logs for homes, buildings, sheds and the like which have been cured after harvesting by forming a pair of oppositely disposed longitudinal saw cuts therein so that the moisture content is substantially reduced and eliminated while curing in the shade so that any cracking will occur along the bottom of the saw cuts.

A further object of the present invention is to provide a method and process of finishing logs by insertion of a wood strip in a groove formed along the saw cuts for obscuring and hiding expansion or escape cracks in the log as well as the saw cuts, so that there is obtained a naturalized log having an essentially natural surface or contour.

Still another object of the present invention is to provide an essentially invisibly filled groove structure within a processed log so that the resulting structure has been ventilated and released of all binding moisture, water, sap and the like resulting in the prevention of rotting of logs.

An additional and further object of the present invention is to provide for the harvesting processing and curing of logs together with insertion of a finishing strip so that the resulting logs are available selectively for use in the construction of furniture, partitions, rafter logs, ceiling joists, truss structures and outside coverings for buildings and the like.

Yet another object of the present invention is to provide a new method of scribing logs along opposite longitudinal dimensions, inserting a saw cut along the scribed dimension or line, curing the log, forming a groove along the opposite side portions of the log over the saw cuts therein, and inserting a spline or wooden strip within the groove for filling it, retaining the spline or strip therein with glue, and then finishing the resulting product so that the peripheral surface of the wooden strip and the log are generally smooth so that a naturalized log product results.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
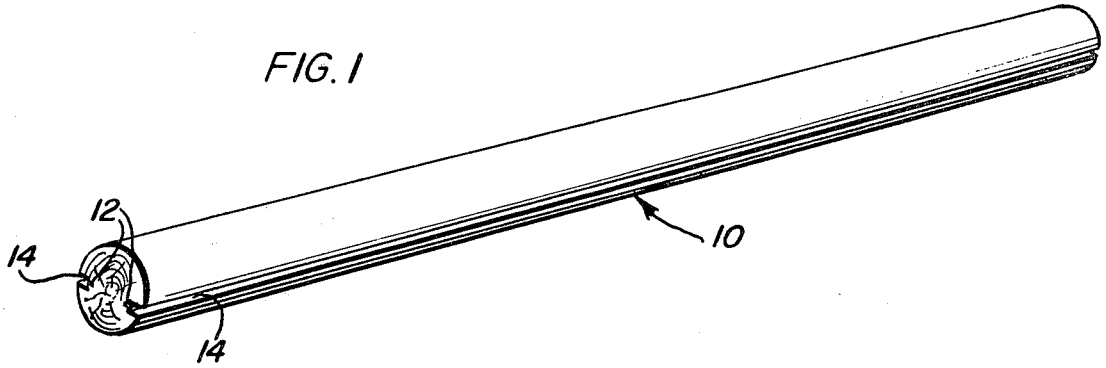
FIG. 1 is a perspective view of a log processed by forming a saw cut along opposite side portions thereof before curing and forming a groove in registry with each saw cut after curing according to an embodiment of the invention.
Figure 2:
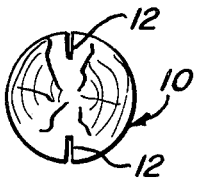
FIGS. 2–5 are sectional views of a log showing the steps and phases of the process according to the preferred embodiment of the present invention.
Figure 3:
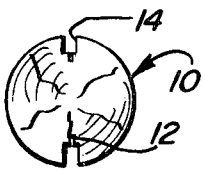

Referring now to the drawings, there is illustrated and shown a log 10 that has been harvested preferably about a month or two after leaf fall, and which, without debarking, has been provided with saw cuts 12 along opposite longitudinal sides of the log. A conventional cutting saw such as a gasoline driven or electric circular saw is applied along scribed lines on the log to form saw cuts 12 along the scribed portions. The log 10 with the bark thereon and the saw cuts therein are cured in 100% shade, preferably in a ventilated shed, for about 7 to 8 months. Any cracks which occur during curing will be concentrated along the bottom of the saw cuts. Thereafter, a saw or a router is used to form a groove 14 along the opposite portions of the log with each groove 14 being in registry with a saw cut 12 as shown in FIG. 3 with the saw cut 12 being deeper than the groove 14. FIG. 2 shows the initial saw cut 12 and FIG. 3 shows a resulting slot or groove 14 cut along each of the opposite sides of the log 10.

One example of the invention is to provide the saw cut on both sides longitudinally of the log so that the depth of the saw cut is about 20% of the diameter of the log, that is about a 1" deep cut for a 5" diameter log. The logs are then placed in storage with the bark thereon, in a ventilated shed where there is no sunlight available thus providing a 100% shade. This storing and curing process extends for 7 or 8 months depending upon environmental conditions and the size of the logs. The cured log with the saw cuts 12 therein and with or without the bark thereon may be used for many purposes with all cracks being in the area of the saw cuts which weaken the log in those areas.

By means of the saw cuts 12 provided in the log 10 along each of the opposite sides thereof, there is provided a release of water, moisture, sap and the like that has been bound therein and the moisture is allowed to escape. The release of moisture and its escape results in cracks, but they are concentrated at the bottoms of the saw cuts rather than on the surface of the logs which prevents log rotting and discoloration caused by water infiltrating into the log through such surface cracks.

After curing, the logs 10 with the saw cuts 12 therein are provided with grooves 14 which may be $\frac{3}{4}$ inch by $\frac{3}{4}$ inch by use of a saw or router with the grooves 14 registering with the saw cuts 12.

Figure 4:
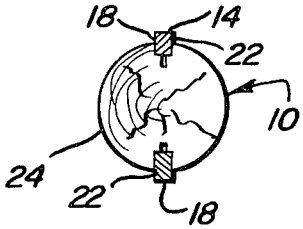

A wooden spline or strip such as a $\frac{3}{4}'' \times \frac{3}{4}''$ or similarly dimensioned wooden strip 18 is used to fill the groove 14 as shown in FIG. 4 and the wooden strip 18 is received directly into the groove 14 and retained therein by a coating of glue or similar material that retains the strip 18 secured and fixed within the groove.

Figure 5:
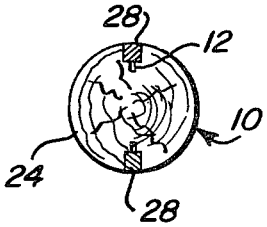
Figure 6:
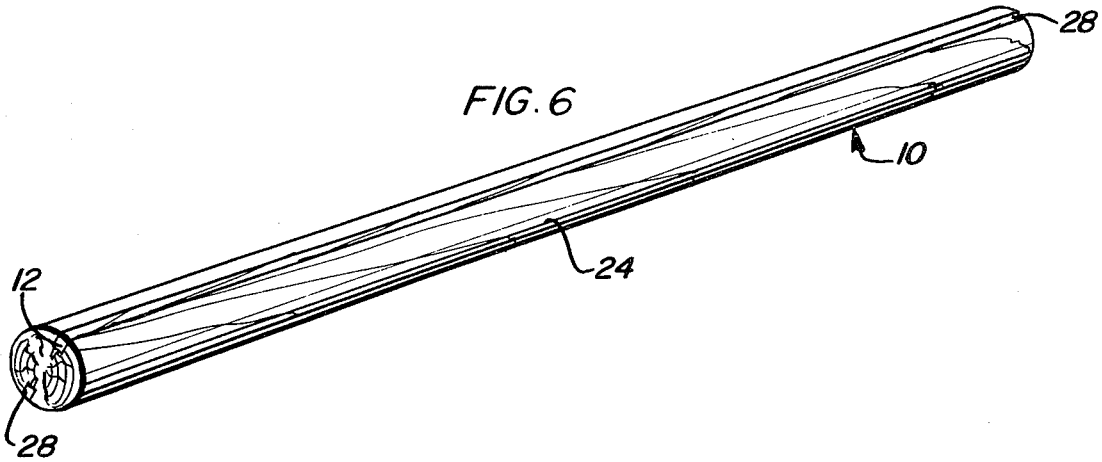
FIG. 6 is a perspective view of a log finished and naturalized according to the steps and processes of the present invention.

After the strip and its attending glue is allowed to dry and it becomes permanently affixed within the log 10, peripheral and exterior portion 22 thereof may be planed, cut, peeled at the same time the log is peeled or debarked or smoothed down so that in final form the strip contours evenly with the adjacent surrounding log surface 24 illustrated and shown in FIGS. 5 and 6 having the finished strip 28 therein for hiding the saw cuts 12 and the expansion grooves 14 and resulting in a finished log product.

The logs may be used as furniture pieces or components, being cut into smaller sized pieces, rafters, partition elements, ceiling joists, trusses and similar structures as well as wall structures formed by a plurality of logs disposed in parallel relation. Essentially, the logs produced by this process remain natural logs that will not have cracks or checks throughout their surface where water from rain, snow or the like can enter to cause discoloration and deterioration. The logs may be disposed in vertical or horizontal relation in forming such structures and in some instances a spline 18 may be placed in only one groove 14 and be dimensioned so that approximately one-half of the spline projects from the log for interlocking reception in the unfilled groove 14 of an adjacent log thereby retaining the adjacent logs in aligned relation. The resulting product provides for a log having grooves which are invisibly filled by wooden strips of like material and the groove is hardly discernible unless by minute inspection to determine the presence of the wooden strip 28.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Method of producing crack free logs comprising the steps of:

forming a saw cut along opposite longitudinal side portions of a log;

curing the log out of the sun;

forming a groove along the opposite side portions of the log with the saw cut positioned in the bottom of the groove; and inserting a spline within and filling at least one of the grooves.

2. The invention of claim 1 wherein the log is smoothed off so the peripheral contour of the spline conforms with the general surface contour of the log when thereafter milled.

3. The invention of claim 1 together with the further step of milling the peripheral surface of the log after the spline has been inserted in the log.

4. The invention of claim 1 together with the further steps of:

harvesting the logs during the winter season;

extending the saw cut to a depth of about 20% of the diameter; and wherein said curing step includes storing the logs in a ventilated shaded shed for about 7 or 8 months.

5. The method of claim 1 together with the further steps of:

glueing the spline insertion within the groove; and peeling and smoothing the extension of the spline and the logs into a continuous smooth surface.

6. The method of claim 1 together with the further steps of:

plowing out the groove to a slot approximately $\frac{3}{4}''$ wide for receiving a strip $\frac{3}{4}'' \times \frac{3}{4}''$ to cover the saw cut;

subsequently glueing the spline within the groove; and subsequently peeling and smoothing the spline even with the log surface.

7. The method of processing and producing logs into crack free logs comprising the steps of:

substantially immediately after harvesting the logs and prior to curing same making a radial saw cut in opposite longitudinal surfaces of each of the logs;

then curing the logs in a ventilated shaded air space so that any cracks which occur will be concentrated along the inner edge of the saw cuts;

forming a wider radial groove in registry with each saw cut;

placing a wood filler strip and securing the same in each wider groove; and peeling the wood strips evenly with the surrounding log producing a contiguous finished log product.

8. The method of claim 7 wherein said steps are performed on the logs without debarking the logs.

9. An improved log structure comprising: a log having a longitudinally extending cut along opposite sides of the log for concentrating crack formation in the cut, a wider longitudinally extending groove in registry with each cut at the outer end of the cut, and a longitudinally extending wood filler strip secured in each groove for hiding the cut, each filler strip having an outer surface which is flush and smooth with the outer surface of the log.

* * * * *